US007137399B1

(12) United States Patent
Ransom et al.

(10) Patent No.: US 7,137,399 B1
(45) Date of Patent: Nov. 21, 2006

(54) COLLAPSIBLE STRUCTURE WITH TOP SUPPORTING ELEMENTS

(76) Inventors: Robert M. Ransom, 8102 Coldwater Rd., Flushing, MI (US) 48433; Todd P. Weston, 7780 Pleasant La., Ypsilanti, MI (US) 48197; Ryan L. Kubica, 8470 Apple Blossom, Flushing, MI (US) 48433; Scott D. Wehner, 4407 W. Stanley Rd., Mt. Morris, MI (US) 48458

( * ) Notice: Subject to any disclaimer, the term of this patent is extended or adjusted under 35 U.S.C. 154(b) by 0 days.

(21) Appl. No.: 10/845,309

(22) Filed: May 13, 2004

Related U.S. Application Data

(60) Provisional application No. 60/470,128, filed on May 13, 2003.

(51) Int. Cl.
*E04H 15/40* (2006.01)
*E04H 15/36* (2006.01)
*E04H 15/26* (2006.01)
*E04H 15/44* (2006.01)

(52) U.S. Cl. ..... 135/128; 135/136; 135/137; 135/138; 135/124; 135/121; 135/143; 135/126; 135/127; 52/79.5; 52/641; 52/649.5; 52/80.1; 52/81.2; 52/81.4; 52/81.5; 52/81.6; 52/82; 52/83

(58) Field of Classification Search ..... 52/79.5, 52/641, 649.5, 63, 80.1–81.6, 82, 83, 86–89, 52/90.1–91.1; 135/92–93, 116–120, 128, 135/132–155, 124, 101, 126–127, 87, 95, 135/98, 121, 129, 143, 148, 157, 160; 206/321
See application file for complete search history.

(56) References Cited

U.S. PATENT DOCUMENTS

| | | | | | |
|---|---|---|---|---|---|
| 1,887,382 | A | * | 11/1932 | Tupper | 101/244 |
| 3,095,886 | A | * | 7/1963 | Frommelt | 135/123 |
| 3,913,968 | A | * | 10/1975 | Luppens | 296/161 |
| 3,990,463 | A | * | 11/1976 | Norman | 135/126 |
| 4,269,210 | A | * | 5/1981 | Marks | 135/125 |
| 4,779,514 | A | * | 10/1988 | Prigmore et al. | 52/79.5 |
| 4,825,891 | A | * | 5/1989 | Machado | 135/138 |
| 4,825,892 | A | * | 5/1989 | Norman | 135/126 |
| 4,941,499 | A | * | 7/1990 | Pelsue et al. | 135/125 |
| 4,951,432 | A | * | 8/1990 | Wilkinson | 52/80.1 |
| 4,951,696 | A | | 8/1990 | Jones, Sr. | |
| 5,038,812 | A | * | 8/1991 | Norman | 135/126 |
| 5,059,463 | A | * | 10/1991 | Peters | 428/64.1 |
| 5,172,526 | A | * | 12/1992 | Morgan | 52/79.5 |
| 5,195,551 | A | * | 3/1993 | Ju | 135/126 |
| 5,205,089 | A | * | 4/1993 | Cunningham | 52/79.1 |
| 5,218,982 | A | | 6/1993 | Kenji | |
| 5,311,813 | A | * | 5/1994 | Fairbanks et al. | 99/645 |

(Continued)

*Primary Examiner*—Jeanette Chapman
(74) *Attorney, Agent, or Firm*—Young Basile

(57) ABSTRACT

The invention is a collapsible structure comprising a plurality of panel elements, each having a coilable frame element and flexible material attached to the frame element. The panel elements are joined to define an enclosure having a roof portion and a bottom perimeter. The bottom perimeter rests on a supporting surface. The structure has at least one roof support rod having a first end and a second end. The first end of the at least one roof support rod is attached to a first location on the bottom perimeter, and the second end of the at least one roof support rod is attached to a second location on the bottom perimeter. The at least one roof support rod is in supporting contact with the roof portion of the enclosure.

2 Claims, 6 Drawing Sheets

U.S. PATENT DOCUMENTS 5,528,849 A 6/1996 Plinta
5,562,225 A * 10/1996 McKenna ..... 220/9.1
5,579,799 A * 12/1996 Zheng ..... 135/126
5,582,197 A * 12/1996 Dobberstein ..... 135/87
5,613,512 A 3/1997 Bean
5,669,403 A 9/1997 Belcher et al.
5,676,168 A * 10/1997 Price ..... 135/126
5,794,640 A * 8/1998 Jang ..... 135/131
5,816,278 A * 10/1998 Kim ..... 135/126
5,842,940 A * 12/1998 Macaluso ..... 473/478
5,871,026 A * 2/1999 Lin ..... 135/98
5,921,260 A * 7/1999 Carter ..... 135/145
6,109,282 A * 8/2000 Yoon ..... 135/126
6,151,841 A * 11/2000 Green ..... 52/79.4
6,202,665 B1 3/2001 O'Hare
6,247,699 B1 * 6/2001 Macaluso ..... 273/400
6,302,127 B1 * 10/2001 Gayton ..... 135/124
6,318,394 B1 * 11/2001 Zheng ..... 135/126
6,325,086 B1 * 12/2001 Shinner et al. ..... 135/126
6,328,050 B1 * 12/2001 McConnell ..... 135/137
6,431,193 B1 * 8/2002 Carter ..... 135/145
6,453,923 B1 * 9/2002 Zheng ..... 135/126
6,481,451 B1 * 11/2002 Zheng ..... 135/126
6,499,498 B1 * 12/2002 Zheng ..... 135/125
6,543,776 B1 * 4/2003 Macaluso ..... 273/400
6,550,491 B1 * 4/2003 Bixler et al. ..... 135/145
6,679,009 B1 * 1/2004 Hotes ..... 52/86
6,779,538 B1 * 8/2004 Morgante et al. ..... 135/128
6,851,136 B1 * 2/2005 Brereton ..... 5/102
6,901,714 B1 * 6/2005 Liapi ..... 52/645

* cited by examiner

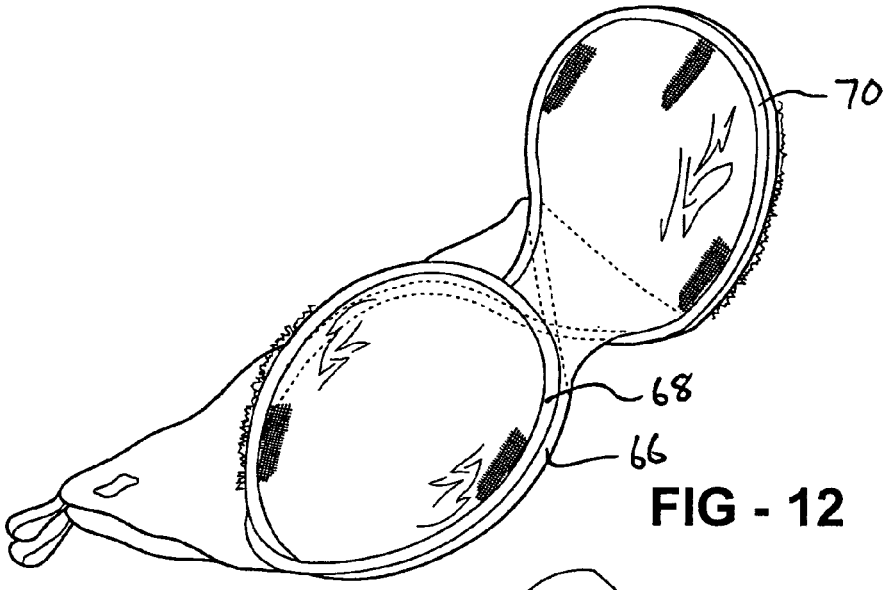
FIG - 12
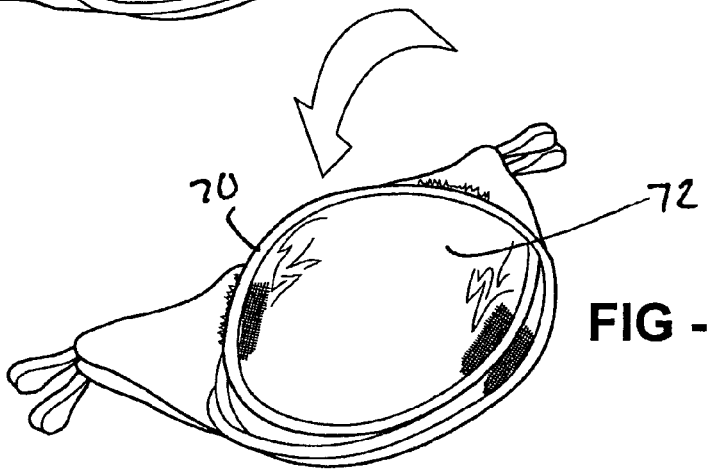
FIG - 13
FIG- 14
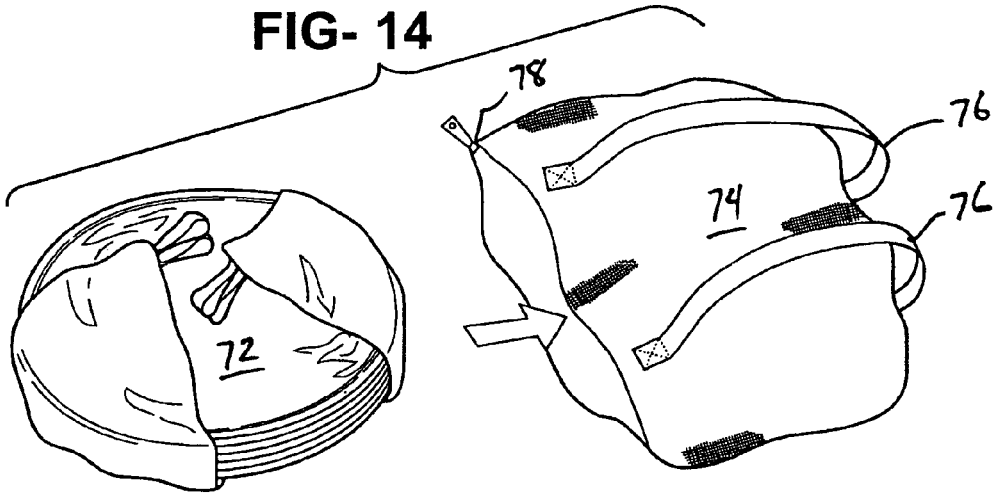

COLLAPSIBLE STRUCTURE WITH TOP SUPPORTING ELEMENTS

PRIORITY CLAIM

This application claims the benefit of U.S. Provisional Application No. 60/470,128, filed May 13, 2003.

FIELD OF THE INVENTION

The present invention relates to portable enclosures for protection from the elements, and more particularly to a collapsible enclosure utilizing flexible roof-support elements in combination with coilable side panel elements.

BACKGROUND OF THE INVENTION

Portable enclosures, such as tents, have been used as blinds and shelters since the beginning of recorded time. The structure and appearance of such enclosures is as varied as human culture.

More recently, portable, lightweight, durable, and affordable enclosures have become a desirable accessory for many outdoor recreational activities, including camping and hunting. The widespread availability of modern lightweight structures and fabrics has resulted in the proliferation of literally hundreds of new designs for portable enclosures. Among the many popular current styles for tents and hunting blinds are the so-called "collapsible" structures that utilize a spring-like framework that can be easily collapsed and folded for transportation and storage. Such popular designs are typified in, for example, our current and co-pending application Ser. No. 10/025,279.

These types of enclosures are inexpensive, lightweight, and convenient to use. However, one drawback in structures of this type is found in the lack of support available for the roof or upper portion of the enclosure. Early designs used the tension created by the pull of the side panels against the top fabric, but the tension applied to the top fabric was limited. Over time, the fabric of the enclosure stretches, and the framework elements lose their resiliency. Eventually, the roof or top portion of the enclosure sags and deforms, restricting head room inside the enclosure and allowing the collection of water and debris on the roof area. In addition, the relaxation of fabric throughout the structure causes an overall loss of rigidity throughout the structure over time.

It is desirable, therefore, to improve the structural integrity of existing collapsible structures by inclusion of lightweight and resilient frame elements that can be easily transported, inserted in the structure of the enclosure and removed with a minimum of difficulty, and that can be easily adapted to cause the roof or upper portion of the enclosure to conform to a particular profile, thereby elevating or extending a portion of the enclosure upward.

SUMMARY OF THE INVENTION

The invention, therefore, is a collapsible structure comprising a plurality of panel elements each having a coilable frame element and flexible material attached to the frame element. These panels elements are joined to define an enclosure having a roof portion and a bottom perimeter. The bottom perimeter rests on a supporting surface. The structure has at least one roof support rod having a first end and a second end, with the first end of the rod attached to a first location on the bottom perimeter and the second end of the rod attached to a second location on the bottom perimeter. The rod is further in supporting contact with the roof portion of the structure.

In one embodiment of the present invention, a first corner and a second corner of the enclosure correspond to the first and second locations on the bottom perimeter. The at least one roof support rod may be made in multiple sections and may be made of a flexible material. In another embodiment, one or more sleeves may be attached to the roof portion of the enclosure and the at least one roof support rod may be disposed within those sleeves.

In another embodiment, the flexible material has an inner surface and an outer surface. Visible patterns may be provided on either or both of the inner surface or outer surface of the flexible material. In addition, a covering element bearing a visible pattern on a first surface and adapted to surround and cover substantially all of the enclosure may be provided. This covering element, which may be reversible, may also have a second visible pattern on a second surface opposing the first surface.

BRIEF DESCRIPTION OF THE DRAWINGS

FIG. 12 is a perspective view showing the fifth step in the folding process of the invention;

FIG. 13 is a perspective view showing the invention as folded prior to insertion in the carrying bag;

FIG. 14 is a perspective view showing the relationship between the folded enclosure and its carrying bag.

DETAILED DESCRIPTION OF THE EMBODIMENT

Figure 1:
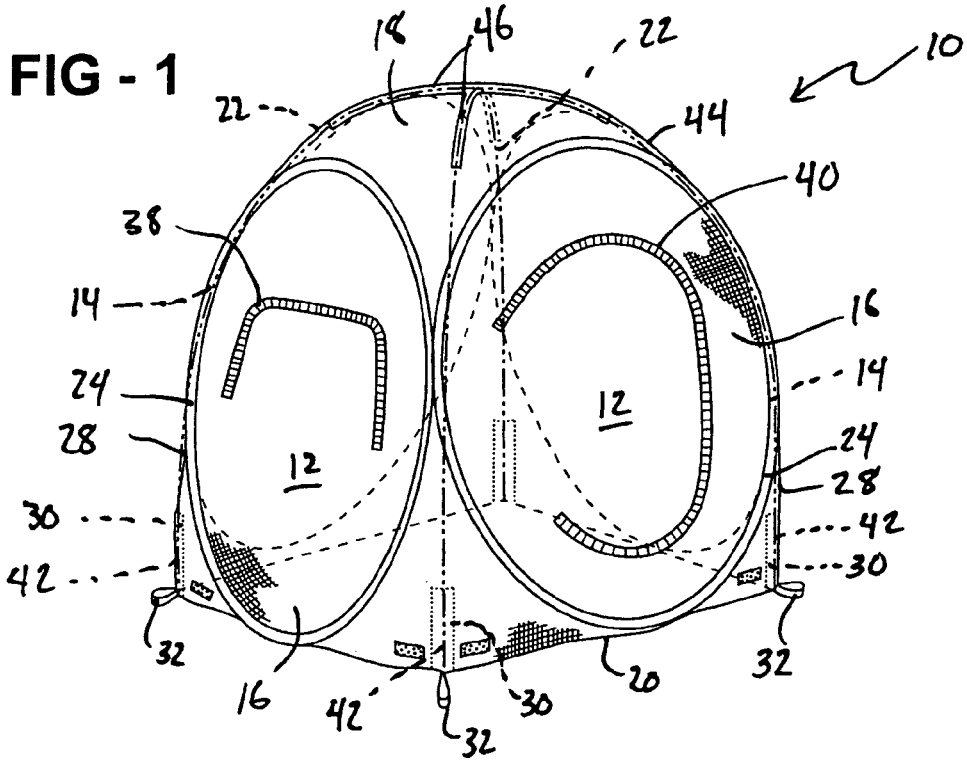
FIG. 1 is a simplified perspective view of the present invention.

FIG. 1 illustrates one embodiment of enclosure 10. Enclosure 10 is designed with sufficient interior volume to accommodate one or more occupants. The overall dimensions of the enclosure are selected to insure the relative comfort of the occupants in the desired activity, which, by way of example in this application, is of a size suitable for hunting. The primary components of enclosure 10 are panel elements 12 each supported by a frame element 14 and substantially composed of a flexible material 16 attached to frame elements 14. The panel elements 12 are joined together to form the enclosure 10, and the completed enclosure 10 includes a roof portion 18 and a bottom perimeter 20. The roof and overall structure are further supported by support rods 22.

Again, in reference to the illustration of the present invention in FIG. 1, each panel element 12 features a frame element 14 captured within a sleeve 24. Frame element 14 is typically made of a resilient or spring-like material, such as spring steel, which is strong and durable, yet lightweight. The sleeve 24 in which frame element 14 is captured is sewn or otherwise attached to flexible material 16, which provides the overall size, shape, and substance of panel element 12. Both sleeve 24 and flexible material 16 may be made from a traditional fabric such as Dacron or linen, however, other materials, such as plastic sheeting, may be used. The size and shape of covering material 16 and attached sleeve 24 determine the appropriate size of frame element 14. When fully constructed, these materials should be sized such that frame element 14 exerts a positive outward bias communicated through sleeve 24 to covering material 16, thus applying tension to the covering material 16 interior to the sleeve 24 and frame element 14. The frame element 14 thus provides a measure of rigidity to panel element 12. Additional portions of covering material 16 may be provided exterior to the circumference formed by sleeve 24 for use in further defining the overall size and shape of panel element 12 and providing margins at which panel element 12 may be joined to additional panel elements 12.

Figure 3:
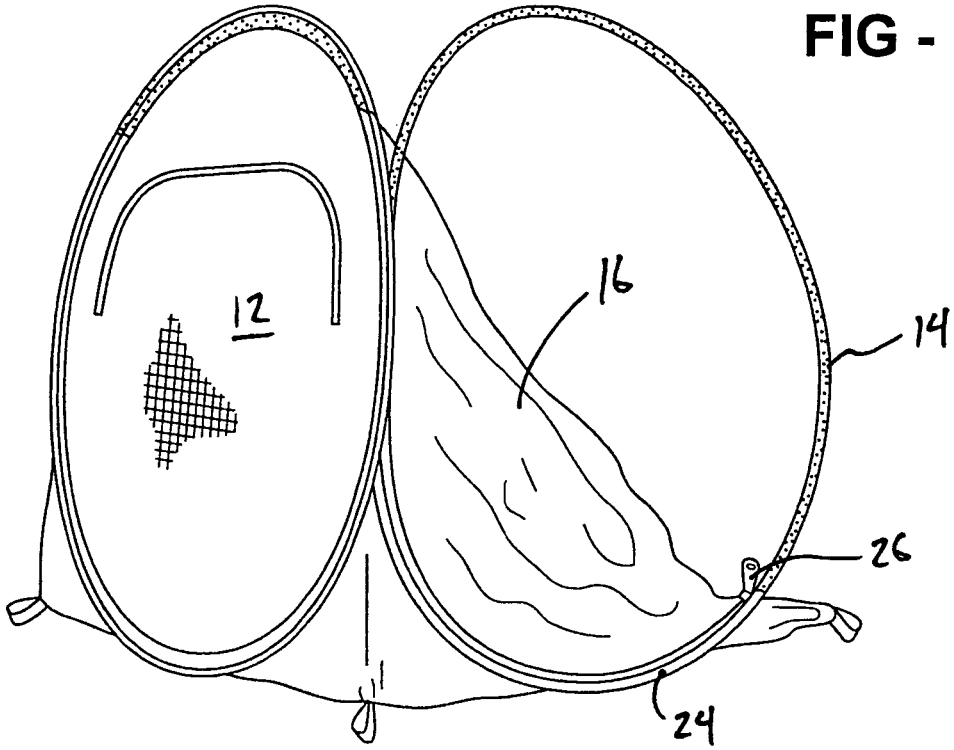
FIG. 3 is a perspective view of another embodiment of the invention, showing the invention in a configuration wherein the fabric panels may be removed from the framework.
Figure 4:
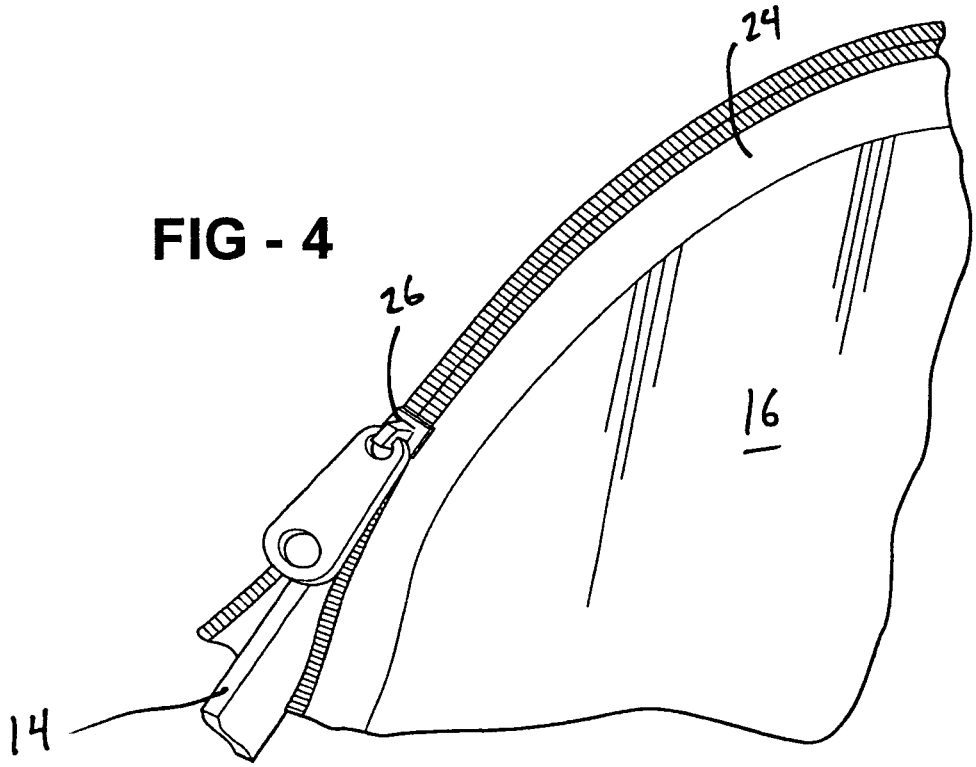
FIG. 4 is a detailed perspective view of one portion of a perimeter of one frame, showing the method of removing the resilient frame from the fabric structure.

Turning to FIGS. 3 and 4, an alternative arrangement of the relationship of frame element 14 with sleeve 24 is shown. In this embodiment, sleeves 24 are provided with closure devices 26, such as zippers, velcro, or the like, permitting access to the interior of sleeve 24 and the removal or replacement of frame element 14 from within sleeve 24. Alternatively, covering material 16 having different sizes or uses may be provided on frame elements 14 to allow additional flexibility for a user. Utilizing this method, an outdoorsman might carry the frame elements 14 for the enclosure 10 and a plurality of covering materials 16 which may be installed upon the frame members at will, providing to the occupant a wide variety of different camouflage or other patterns for different environments and seasons. Each covering material 16 may be reversible, so that one covering provides two discrete patterns or colors to the user.

Returning to FIG. 1, additional detail pertaining to the construction of enclosure 10 will now be described. Panel elements 12 each having a frame element 14 and covering material 16 provided on frame element 14 through sleeve 24 are arranged in adjacent positions and joined at panel edges 28. Panel elements 12 may be joined at panel edges 28 by a sewn seam or other appropriate means. Interior corner pockets 30 are provided at the lower corners of panel edges 28. In addition, stake loops 32 may be provided on the exterior lower corners of panel edges 28 where adjoining panel elements 12 come together. Stake loops 32 may be used to tie or otherwise secure enclosure 10 to a mounting surface, as depicted in an exemplary embodiment shown in FIG. 7, wherein a stake 34 is used to secure the enclosure 10 to the ground 36 through stake loop 32. Returning to FIG. 1, joined panel elements 12 further meet at the top of enclosure 10 to form a roof portion 18. Roof portion 18 may be formed from covering material 16 on panel elements 12, or it may be provided as a separate piece of material. Access ports, such as a window 38 or door 40 may be provided on one or more panel elements 12. Windows 38 and doors 40 may also be provided with closures such as zippers, velcro, snaps, buttons, or the like. These windows 38 and doors 40 permit ingress and egress to the user, as well as viewing of the area outside of the enclosure, the firing of weapons, or the utilization of photographic equipment. The use of reversible closures, such as reversible zippers, on the windows 38 and doors 40 of enclosure 10 ensures that the utility of such windows 38 and doors 40 regardless of which side of the covering is outermost.

Figure 2:
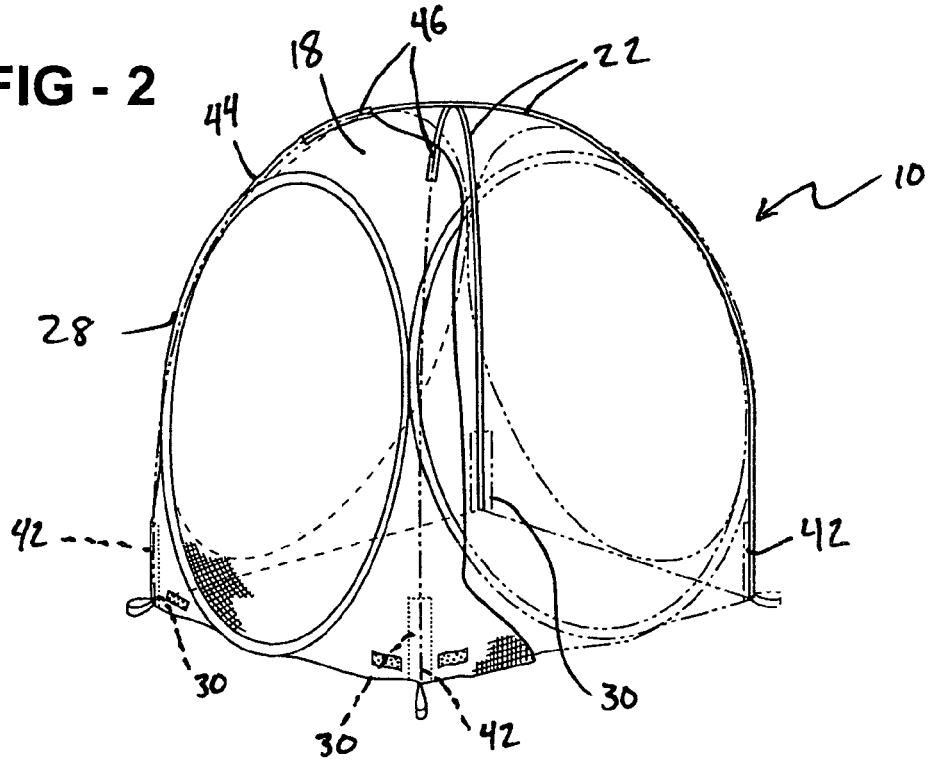
FIG. 2 is a simplified and partially cut-away perspective view of the invention showing the relative position of the support rods in relation to the rest of the structure.

Returning now to FIGS. 1 and 2, the installation and operation of support rods 22 will be shown. In the illustrated embodiment as shown in FIGS. 1 and 2, support rods 22 are substantially arcuate in shape. Each support rod 22 has support rod ends 42. Support rod ends 42 are inserted into and reside within corner pockets 30 formed along the lower portion of panel edges 28 of the enclosure 10. Support rods 22 generally traverse panel edges 28 and are dimensioned to occupy the full diagonal perimeter 44 of the enclosure 10. In one embodiment, support rods 22 traverse the interior diagonal perimeters 44 of enclosure 10 and support roof portion 18 from within the enclosure 10. Alternatively, sleeves 46 may be provided on the exterior of roof portion 18 of enclosure 10 and support rods 22 may traverse the exterior of the diagonal perimeter 44 of the enclosure 10, engaging sleeves 46, thereby supporting roof portion 18. Sleeves 46 may be formed from any suitable material and attached to roof portion 18 by sewing or other means known in the art. Suitable substitutes for sleeves 46 may be provided, such as hook-and-loop fasteners or ties that may be fastened to support rods 22 at various points along the diagonal perimeters 44 of the enclosure 10. Each support rod 22 may be constructed in a unitary fashion from a rigid material, however, better results may be achieved if each rod 22 is constructed in multiple sections. These sections may be disassembled for easy transportation and storage. Support rods 22, whether unitary or sectioned, are ideally constructed from a substantially rigid yet somewhat flexible material such as spring steel, aluminum alloys, carbon fibers, or composites. If constructed in a unitary fashion, it is desirable for support rods 22 to be made from a material similar to that used for frame elements 14 such that support rods 22 could be coiled to a diameter approximately one-third of their overall size for easy transportation and storage with collapsed enclosure 10.

The support obtained from the use of support rods 22 allows for an increased variety of configurations of the overall enclosure 10. In one embodiment, it may be preferable to significantly extend roof portion 18 in a vertical direction. In such an embodiment, support rods 22 may be dimensioned in such a way as to support a vertically extended roof portion 18. In another embodiment, it may be desirable to eliminate a frame element 14 from one panel element 12 on enclosure 10. This may be done to accommodate a door 40 having a significantly larger size, or simply to conserve material used in the enclosure 10 when it is carried on long trips to remote locations. In addition to these embodiments, it will be appreciated that the enclosure 10 may be provided with as many panel elements 12 as are suitable for a particular application. Most enclosures 10 will require the use of at least three panel elements 12 for suitable stability, and other embodiments may have six or more panel elements 12. In an embodiment having an odd number of panel elements 12, it is desirable to allow at least one panel edge 28 to be opened by way of removable fasteners or the like (not shown) in order that all panel elements 12 may be properly collapsed upon each other in preparation for coiling and storage.

Figure 5:
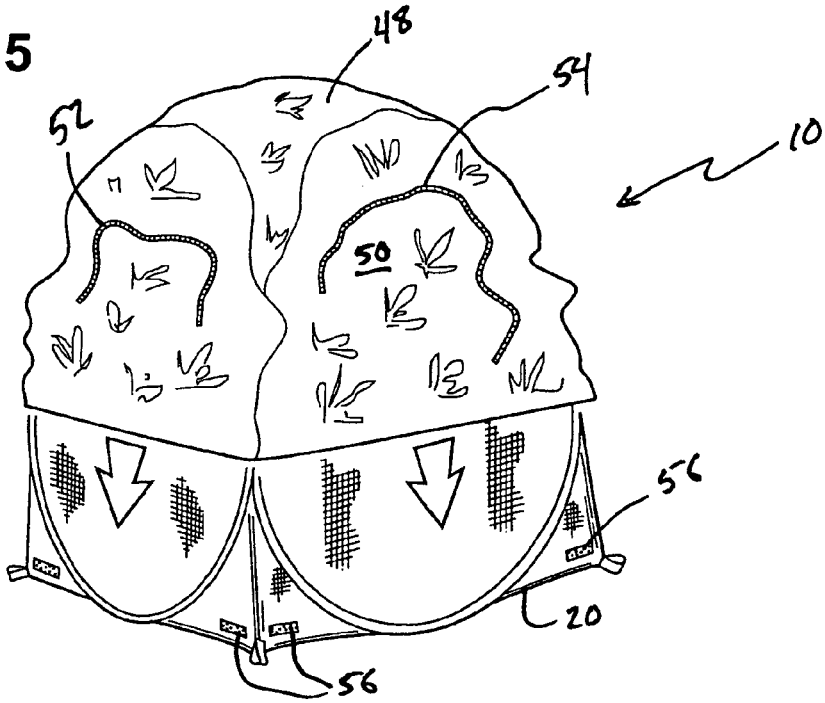
FIG. 5 is a perspective view of the invention, showing an embodiment utilizing a removable cover.
Figure 6:
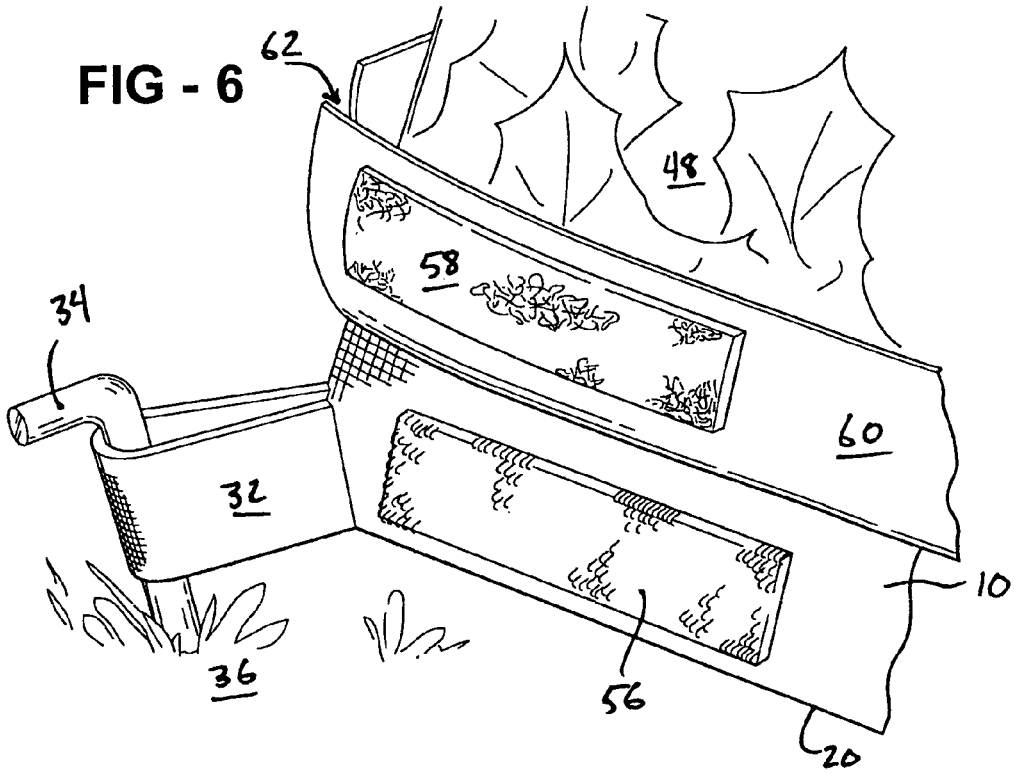
FIG. 6 is a detailed perspective view of one corner of the invention, showing a method of fixation of the removable cover to the underlying structure.

FIG. 5 illustrates another embodiment of the present invention. In this embodiment, the enclosure 10 includes a removable covering 48 bearing a visible pattern 50. The covering 48 is manufactured in a size slightly larger than the outside dimension of the erected enclosure 10. In this fashion, the covering 48 bearing a visible pattern 50 may be drawn over the exterior of enclosure 10, much as a glove is drawn over a hand, providing a new appearance for the enclosure 10. In this embodiment, the covering 48 bears a color, camouflage, background-matching, or other visible pattern 50 which is different from the color, camouflage, background-matching, or other visible pattern of the underlying enclosure 10. Removable covering 48 may be constructed from any appropriate material, including materials lighter in weight than materials used for covering material 16, as removable covering 48 is dimensioned such that it does not bear the tensioning stresses provided by frame elements 14 and support rods 22. Removable covering 48 is also provided with one or more windows 52 and doors 54, preferably dimensioned to align substantially with windows 38 and doors 40 of underlying enclosure 10 when removable covering 48 is in a fully installed position. Windows 52 and doors 54 are provided with appropriate closures, such as zippers, velcro, snaps, or the like to permit repeated opening and closing of windows 52 and doors 54. Fasteners 56 are provided at appropriate intervals along bottom perimeter 20 of enclosure 10 to aid in securing covering 48 to enclosure 10. As can be seen in detail in FIG. 6, a corresponding fastener is provided along the bottom margin 60 of removable covering 48 to cooperate with fastener 56 on enclosure 10 and thus secure removable covering 48 to enclosure 10. Fasteners 56 and 58 may be any fastener suitable for the application, such as velcro, snaps, ties, buttons, or the like. Bottom margin 60 of removable covering 48 may be further provided with slits 62 at the corners to accommodate stake loops 32.

Figure 7:
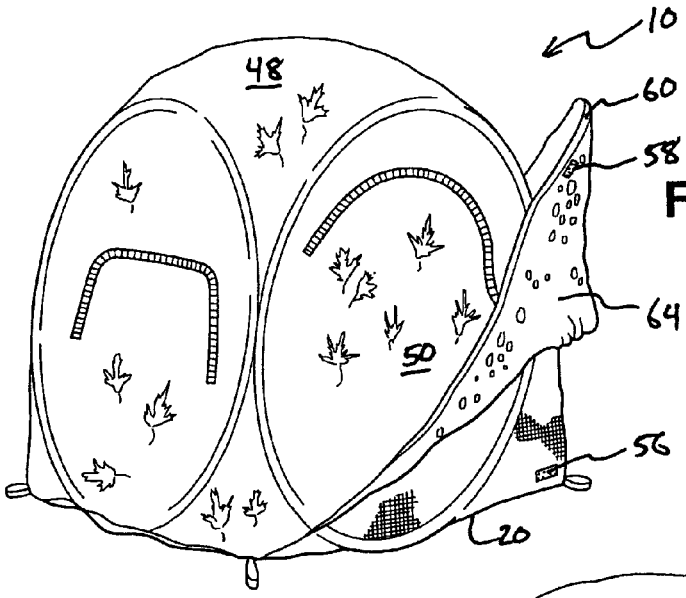
FIG. 7 is a perspective view of the invention, showing the reversibility of the removable cover.

FIG. 7 illustrates yet another embodiment of the present invention in which removable covering 48 is also reversible. In this embodiment, removable covering 48 bears a first visible pattern 50 on one side and a second visible pattern 64 on the reverse side of removable covering 48.

Figure 8:
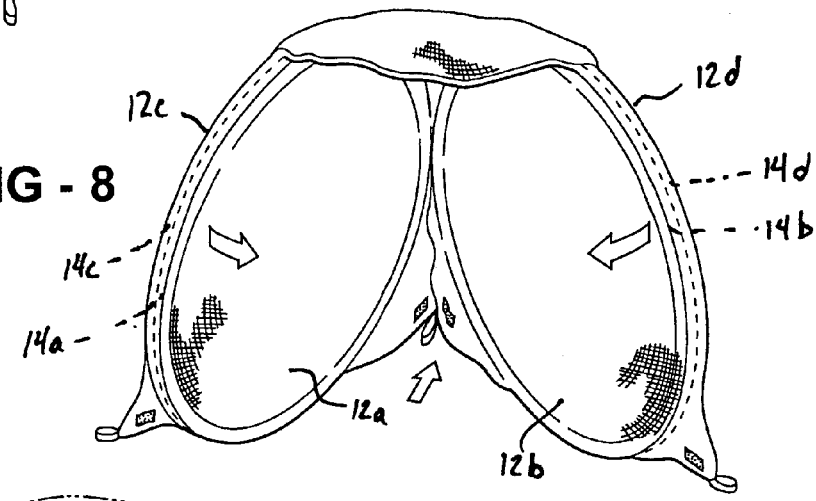
FIG. 8 is a perspective view showing the first step in the folding process of the invention.
Figure 9:
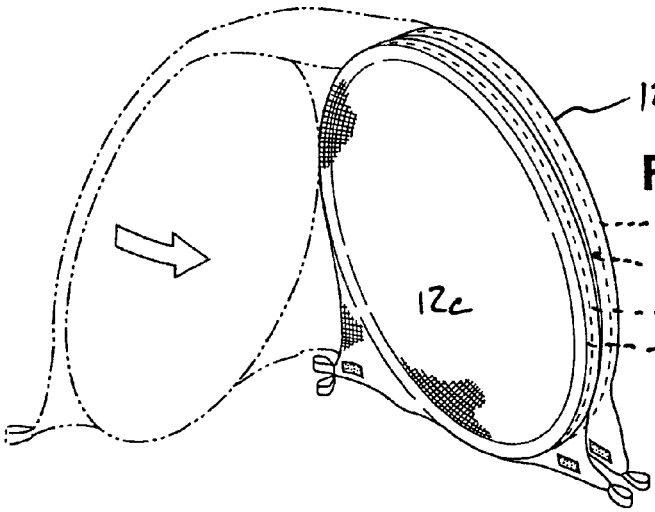
FIG. 9 is a perspective view showing the second step in the folding process of the invention.
Figure 10:
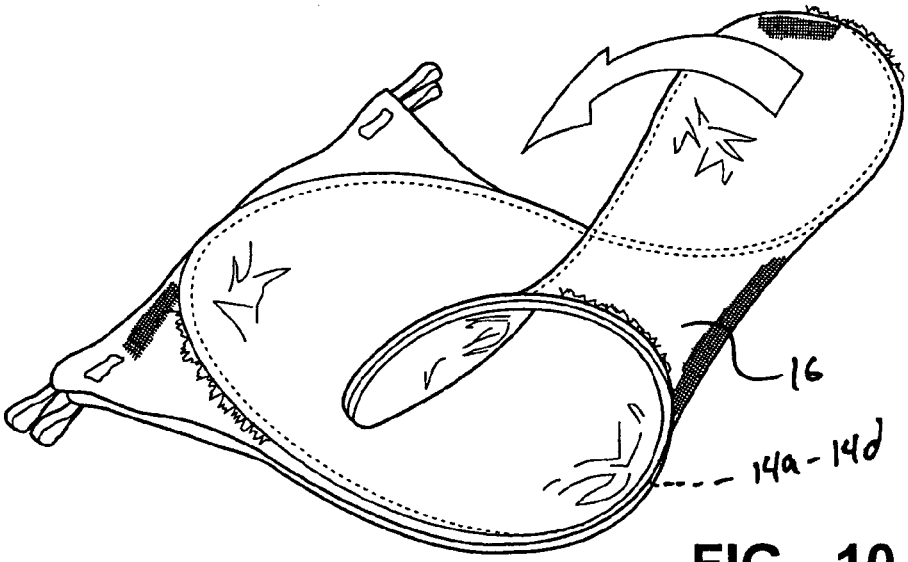
FIG. 10 is a perspective view showing the third step in the folding process of the invention.
Figure 11:
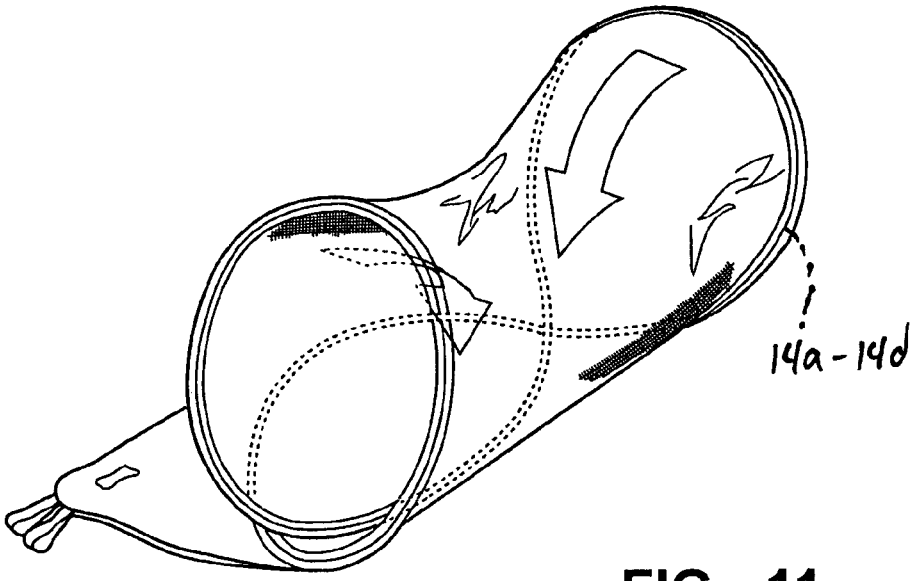
FIG. 11 is a perspective view showing the fourth step in the folding process of the invention.

Turning now to FIGS. 8–13, the collapsing of the enclosure 10 will be described. The collapsing process may be performed with the frame elements 14 alone, with the frame elements 14 covered by a covering material 16, or with the frame elements 14 covered by the covering material 16 and one or more removable coverings 48. In the embodiment shown in FIG. 1, the enclosure 10 comprises four panels elements 12, each having a frame element 14, and erected in such a fashion as to present a quadrilateral enclosure 10 having a roof portion 18. After removing roof support rods 22, inasmuch as the covering material 16 is flexible, the enclosure 10 may be flattened, as shown in FIG. 8 by urging panel element 12*a* against panel element 12*c* and panel element 12*b* against panel element 12*d*. In this configuration, the frame element 14*a* associated with panel element 12*a* is brought into contact with frame element 14*c* associated with panel element 12*c*, and frame element 14*b* associated with panel element 12*b* is brought into contact with frame element 14*d* associated with panel element 12*d*. Thereafter, as shown in FIG. 9, panel elements 12*a* and 12*c* and associated frame elements 14*a* and 14*c* are folded in the direction of the arrow, thereby stacking panel elements 12*a*–12*d* against one another, thereby bringing into superimposed contact frame elements 14*a*–14*d*. Next, as shown in FIG. 10, simply twisting the stack of superimposed frame members into a U-shaped configuration initiates the folding process. A second twist as shown by the arrows in FIG. 11 results in the formation of three overlapping coils of resilient material each having a substantially smaller diameter than the diameter of the frame members above-described. The three coils 66, 68, and 70 are shown in FIG. 12. When the three coils 66, 68, and 70 are superimposed, they form a compact package 72 which may be easily transported. In the preferred embodiment, the invention is provided with a container 74 adapted to enclose and restrain the collapsed enclosure or framework. The container 74 may be provided with one or more pockets (not shown) in which to store one or more removable coverings 48. Further, the container may be provided with shoulder straps 76 and a closure 78 to facilitate carrying. In this fashion, the user may conveniently carry the framework, the principal enclosure, or the framework, principal fabric covering, and a plurality of additional coverings.

While the invention has been described in connection with what is presently considered to be the most practical embodiments, it is to be understood that the invention is not to be limited to those disclosed embodiments. To the contrary, it is intended to cover various modifications and equivalent arrangements included within the spirit and scope of the appended claims, which scope is intended to be accorded the broadest interpretation so as encompass all such modifications and equivalent structures as is permitted under the law.

Accordingly, we claim:

The invention claimed is:

1. A collapsible structure, comprising:

a plurality of panel elements each having a coilable frame element and flexible material attached to the frame element, the flexible material of the panel elements joined to define an enclosure having a roof portion and a bottom perimeter, said bottom perimeter resting on a supporting surface, at least one roof support rod having a first end and a second end, the first end of the at least one roof support rod attached to a first location on the bottom perimeter, the second end of the at least one roof support rod attached to a second location on the bottom perimeter, the at least one roof support rod in supporting contact with the roof portion, a covering element bearing a visible pattern on a first surface and adapted to surround and cover substantially all of said enclosure, wherein said covering element further comprises a second surface opposing said first surface and bearing a second visible pattern, and wherein said covering element is reversible so that the second surface is selectively visible from the exterior of the enclosure.

2. A collapsible structure, comprising:

four panel elements each having a coilable frame element and flexible material attached to the frame element, the flexible material of the four panel elements joined to define an enclosure having a roof portion and a first corner, a second corner, a third corner, and a fourth corner, wherein the first and third corners are opposite corners, and the second and fourth corners are opposite corners, said first, second, third, and fourth corners resting on a supporting surface, a first roof support rod and a second roof support rod each having a first end and a second end, the first end of the first roof support rod attached to the first corner, the second end of the first roof support rod attached to the third corner, the first end of the second roof support rod attached to the second corner, the second end of the second roof support rod attached to the fourth corner, the first and second roof support rods in supporting contact with the roof portion, a covering element bearing a visible pattern on a first surface and adapted to surround and cover substantially all of said enclosure, wherein said covering element further comprises a second surface opposing said first surface and bearing a second visible pattern, and wherein said covering element is reversible so that the second surface is selectively visible from the exterior of the enclosure.

* * * * *